US010961966B2

(12) United States Patent
Ilia et al.

(10) Patent No.: US 10,961,966 B2
(45) Date of Patent: Mar. 30, 2021

(54) SACKLESS FUEL NOZZLE COMPRISING ARRANGED WITH A PROTRUDING TIP

(71) Applicant: SCANIA CV AB, Södertälje (SE)

(72) Inventors: Raoul Ilia, Södertälje (SE); Christoffer Lind, Ängelholm (SE)

(73) Assignee: Scania CV AB, Södertälje (SE)

( * ) Notice: Subject to any disclaimer, the term of this patent is extended or adjusted under 35 U.S.C. 154(b) by 42 days.

(21) Appl. No.: 16/303,064

(22) PCT Filed: May 16, 2017

(86) PCT No.: PCT/SE2017/050509
§ 371 (c)(1),
(2) Date: Nov. 19, 2018

(87) PCT Pub. No.: WO2017/204722
PCT Pub. Date: Nov. 30, 2017

(65) Prior Publication Data

US 2019/0301417 A1 Oct. 3, 2019

(30) Foreign Application Priority Data

May 24, 2016 (SE) ..... 1650716-2

(51) Int. Cl.
*F02M 61/18* (2006.01)
*F02M 61/10* (2006.01)
*F02M 61/08* (2006.01)

(52) U.S. Cl.
CPC ..... *F02M 61/1813* (2013.01); *F02M 61/10* (2013.01); *F02M 61/08* (2013.01)

(58) Field of Classification Search
CPC ..... B01D 2201/00; B03D 1/12; F02M 51/00; F02M 53/00; F02M 61/00; F02M 61/10;
(Continued)

(56) References Cited

U.S. PATENT DOCUMENTS 2,592,111 A * 4/1952 Bischof ..... F02M 61/08 239/533.7
4,909,444 A * 3/1990 Sczomak ..... F02M 61/045 239/453

(Continued)

FOREIGN PATENT DOCUMENTS

DE 10318989 A1 11/2003
EP 972934 A2 1/2000

(Continued)

OTHER PUBLICATIONS

Scania CV AB, International Application No. PCT/SE2017/050509, International Preliminary Report on Patentability, dated Nov. 27, 2018.

(Continued)

*Primary Examiner* — Joseph A Greenlund
(74) *Attorney, Agent, or Firm* — Moore & Van Allen PLLC; W. Kevin Ransom

(57) ABSTRACT

A fuel injector has an injector nozzle with nozzle body having internal room and nozzle wall hole connecting this room to exterior of the nozzle body. A valve needle is movable in a longitudinal direction and received in the internal room. The valve needle has an internal fuel channel with inlet located at a circumferential surface of a first portion. The nozzle wall hole has a circular cross-section with the same diameter as the first valve needle portion defined by walls extending in parallel with the longitudinal direction of the needle. The fuel inlet of the fuel channel is located on said walls of the nozzle wall hole in a second position to prevent fuel entering the fuel channel and located inside the internal room in a first position for receiving fuel from this internal room and injecting it into a combustion chamber of a cylinder of an engine.

19 Claims, 3 Drawing Sheets

(58) Field of Classification Search
CPC ..... F02M 61/18; F02M 61/1813; F02M 61/1866–1893; F02M 63/0078; F02M 61/12; F02M 61/188; F02M 61/08; F02M 57/026
USPC ..... 239/533.12, 533.7
See application file for complete search history.

(56) References Cited

U.S. PATENT DOCUMENTS

| | | | | | |
|---|---|---|---|---|---|
| 5,063,898 | A * | 11/1991 | Elliott | F02M 49/02 | 123/297 |
| 5,458,292 | A * | 10/1995 | Hapeman | F02M 43/04 | 239/533.4 |
| 7,484,494 | B2 | 2/2009 | Lippert et al. | | |
| 8,701,627 | B2 * | 4/2014 | Hokkanen | F02D 41/3035 | 123/298 |
| 2005/0145713 | A1 * | 7/2005 | Reiter | F02M 63/008 | 239/88 |
| 2007/0175440 | A1 * | 8/2007 | Lippert | F02M 61/1813 | 123/305 |
| 2011/0232606 | A1 * | 9/2011 | Peters | F02M 61/1806 | 123/445 |
| 2014/0048036 | A1 * | 2/2014 | Zoeller | F02M 61/182 | 123/294 |
| 2014/0306034 | A1 * | 10/2014 | Schmieder | F02M 51/061 | 239/585.5 |
| 2019/0301417 | A1 * | 10/2019 | Ilia | F02M 61/10 | |

FOREIGN PATENT DOCUMENTS

| | | | | | |
|---|---|---|---|---|---|
| EP | 2505820 | A1 | | 10/2012 | |
| EP | 2650527 | A1 | * | 10/2013 | F02M 61/1846 |
| GB | 659652 | A | * | 10/1951 | F02M 61/10 |
| GB | 659652 | A | | 10/1951 | |
| JP | 09236069 | | * | 9/1997 | F02M 61/06 |
| JP | H09236069 | A | | 9/1997 | |
| KR | 20100138095 | A | | 12/2010 | |

OTHER PUBLICATIONS

International Search Report for PCT/SE2017/050509 dated Nov. 7, 2017.
Written Opinion of the International Searching Authority for PCT/SE2017/050509 dated Nov. 7, 2017.

* cited by examiner

SACKLESS FUEL NOZZLE COMPRISING ARRANGED WITH A PROTRUDING TIP

CROSS-REFERENCE TO RELATED APPLICATIONS

This application is a national stage application (filed under 35 § U.S.C. 371) of PCT/SE2017/050509, filed May 16, 2017 of the same title, which, in turn, claims priority to Swedish Application No. 1650716-2, filed May 24, 2016; the contents of each of which are hereby incorporated by reference.

FIELD OF THE INVENTION

The present invention relates to a fuel injector for an internal combustion engine comprising an injector nozzle with a nozzle body.

BACKGROUND OF THE INVENTION

The present invention relates to a fuel injector for an internal combustion engine comprising an injector nozzle with a nozzle body having an internal room and a nozzle wall hole connecting this room to the exterior of the nozzle body, a valve needle movable in a longitudinal direction thereof and received in the internal room of the nozzle body while extending into said hole, the valve needle having at least one internal fuel channel with an outlet to be located to open to the exterior of the nozzle body in a first position of said valve needle with respect to the nozzle body allowing fuel to exit the outlet for being injected into a combustion chamber of a cylinder of said engine, and means configured to move the valve needle in the longitudinal direction thereof between a second position in which parts of the valve needle and of the nozzle body co-operate to prevent fuel to exit said outlet and said first position.

Such a fuel injector has no sack and by that not the disadvantages mentioned above of the presence of a sack, and fuel injectors of this type without a sack is known through for instance EP 0 972 934 B1 and US 2005/0145713 A1. However, these known fuel injectors have an inner fuel accumulator in the valve needle, which results in a restriction of the amount of fuel possible to inject into a cylinder and also a restriction with respect to durations of the injection of fuel.

SUMMARY OF THE INVENTION

The object of the present invention is to provide a fuel injector of the type known through the publications mentioned above being improved in at least some aspect with respect to the known such fuel injectors.

This object is according to the invention obtained by providing such a fuel injector with the features listed in the characterizing part of appended patent claim 1.

By the fact that said at least one fuel channel in said first position of the valve needle allowing fuel to exit the outlet for being injected into a combustion chamber of a cylinder of the engine extends to receive fuel from the internal room of the nozzle body there will be no inner accumulator in the valve needle with the disadvantages associated therewith, neither will there be any sack in said nozzle body. Furthermore, the circular cross-section of the nozzle wall hole with the same diameter as the first valve needle portion and defined by walls extending in parallel with the longitudinal direction of the needle makes it possible to efficiently close said at least one fuel channel in the second position of the valve needle while preventing leakage of fuel from the internal room of nozzle body through the nozzle wall hole past the valve needle. This fit of the first valve needle portion in the nozzle wall hole does also ensures that in said first position of the valve needle the fuel will flow from the internal room of the nozzle body through said at least one fuel channel to the outlet thereof for being injected into a combustion chamber of a cylinder of the engine and no part of the fuel will pass outside the valve needle to reach the combustion chamber through the nozzle wall hole.

According to an embodiment of the invention the internal room of the nozzle body has a bottom surface surrounding said nozzle wall hole and the valve needle has a second portion connected to said first portion with an enlarged cross-section with respect to the latter, and said second valve needle portion has an outer surface configured to come to bear sealingly against the bottom surface of the internal room of the nozzle body in said second position of the valve needle inside the nozzle body. This shape of the second valve needle portion adapted to the bottom surface of the internal room of the nozzle body ensures a very efficient sealing of the internal room of the nozzle body with respect to the nozzle wall hole and then also the inlet of said at least one fuel channel and the combustion chamber of a said cylinder in said second position of the valve needle inside the nozzle body.

According to another embodiment of the invention said bottom surface of the internal room of the nozzle body defines a cross-section of this room perpendicularly to said longitudinal direction of the valve needle tapering towards said nozzle wall hole, and the cross-section of said second portion of the valve needle tapers correspondingly. Such tapering shapes of the valve needle and the internal room of the nozzle body results in a reliable said sealing in the second position of the valve needle also after a long operation life of the fuel injector.

According to another embodiment of the invention said at least one fuel channel has a rectilinear extension between said inlet and outlet. This means that fuel will inevitably be injected "obliquely" into the combustion chamber of a cylinder, which means in a direction making an angle different from 0° with the longitudinal and movement direction of the valve needle, and according to another embodiment of the invention said at least one fuel channel has said outlet opening to spray fuel out therethrough in a direction making an angle above 0° with respect to said longitudinal direction of the valve needle, preferably 10°-80°, more preferably 10°-60° and most preferably 15°-45°. Injection into the combustion chamber of a cylinder at such angles results in an increased turbulence inside the combustion chamber with respect to the case of injecting fuel in the direction along said longitudinal direction and by that an improved combustion of the fuel inside the combustion chamber.

According to another embodiment of the invention the outlet of said at least one fuel channel is located in a third valve needle portion defining a tip of the valve needle with a reduced cross-section with respect to the cross-section of the first valve needle portion.

According to another embodiment of the invention said at least one fuel channel has a diameter of preferably 0.2 mm and more preferably 0.1 mm. These dimensions of the at least one fuel channel in the valve needle are suitable for obtaining appropriate injection of fuel into the combustion chamber of a cylinder of a compression ignited engine.

According to another embodiment of the invention said first portion of the valve needle has a diameter of preferably 0.2-2 mm, more preferably 0.3-0.8 mm and most preferably approximately 0.5 mm.

According to another embodiment of the invention the valve needle has a plurality of separate said fuel channels with fuel inlets distributed around the periphery of the first valve needle portion and outlets separated from each other. This results in an advantageous spread of the fuel injected through the fuel injector and by that an efficient combustion of the fuel in the cylinder with a minimum of hydrocarbon emissions created.

According to another embodiment of the invention the inlets of the fuel channels are uniformly distributed around the periphery of the first valve needle portion. Such uniform distribution promotes efficient injection of fuel into a combustion chamber of a cylinder and smooth operation of the engine.

According to another embodiment of the invention the outlets of the fuel channels are uniformly distributed around a longitudinal center axis of the valve needle. This results in favorable conditions for a combustion of fuel inside a said cylinder with a minimum of hydrocarbon emissions created.

The invention also relates to an internal combustion engine and a motor vehicle according to the appended claims directed thereto.

Other advantageous features as well as advantages of the present invention appear from the description following below.

BRIEF DESCRIPTION OF THE DRAWINGS

With reference to the appended drawings, below follows a specific description of an embodiment of the invention cited as an example. In the drawings.

DETAILED DESCRIPTION OF THE INVENTION

Figure 1:
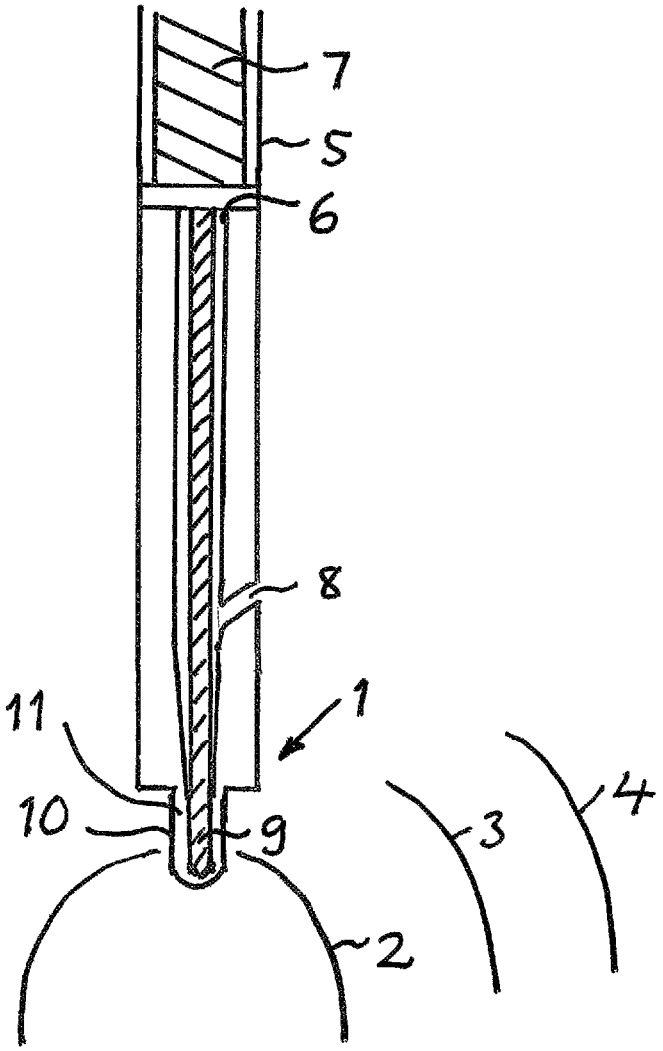
FIG. 1 is a simplified cross-section view showing a schematic structure of a fuel injector of the type to which the present invention belongs.

FIG. 1 illustrates schematically the general structure of a fuel injector 1 of the type to which the present invention belongs for injecting fuel into a cylinder 2 of an internal combustion engine 3 in a motor vehicle 4. The injector has a pump body 5 with a pumping chamber 6 and a piston 7 movably arranged therein. It is schematically shown how fuel may be introduced into the pumping chamber through a channel 8. An injector plunger 9, in the present case a valve needle, is movably arranged in a nozzle body 10 of an injector nozzle 11 and held, by a spring member not shown, in a state closing a connection of fuel in the pumping chamber 6 and by that in an internal room not shown of the nozzle body 10 with the interior of the cylinder 2 through fuel channels through the valve needle not shown in these figures but discussed below while making reference to FIGS. 2-4. A fuel injector is configured to inject fuel into the cylinder 2 as of a fuel pressure inside the pumping chamber 6 and by that inside the internal room of the nozzle body of a predetermined level overcoming the action of the spring member and moving the valve needle in the direction of the arrow A in FIG. 3. Thus, this fuel injector is a pump injector, but the invention is not restricted to any special type of fuel injectors but is particularly applicable to common rail injectors.

Figure 2:
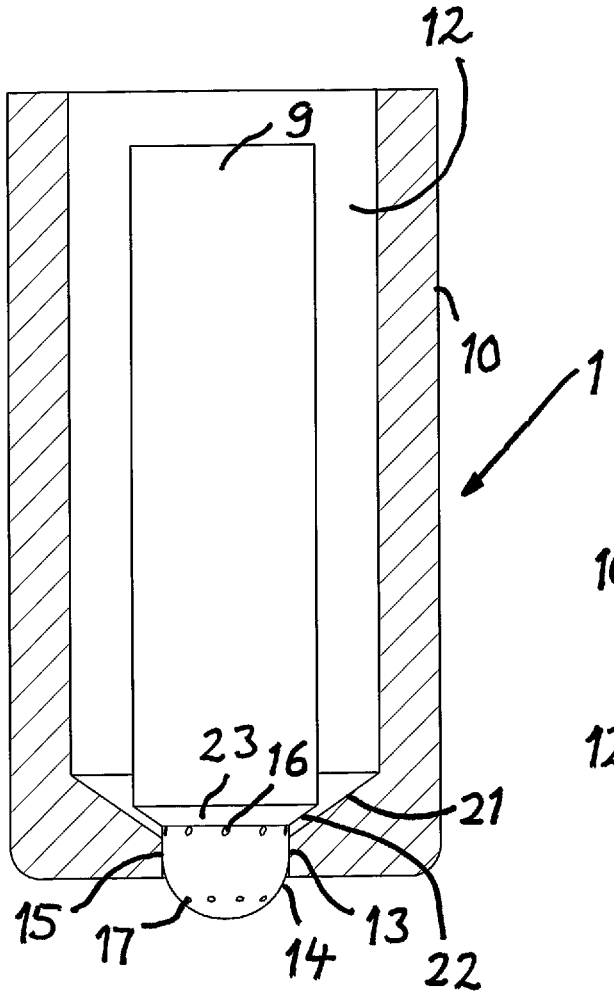
FIGS. 2 and 3 are schematic partially sectioned views showing a valve needle in an internal room of a nozzle body in a first position allowing fuel to be injected into the combustion chamber of a cylinder of an engine and in a second position preventing such injection, respectively.
Figure 3:
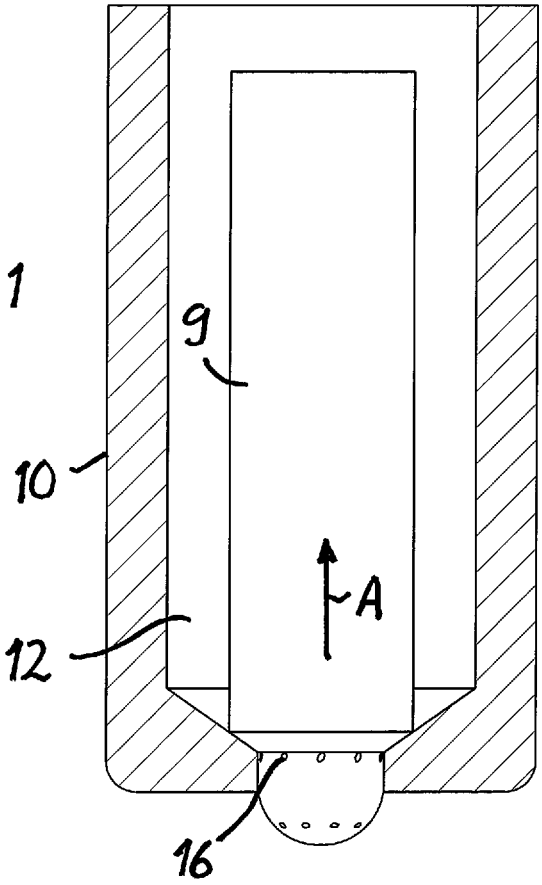
Figure 4B:
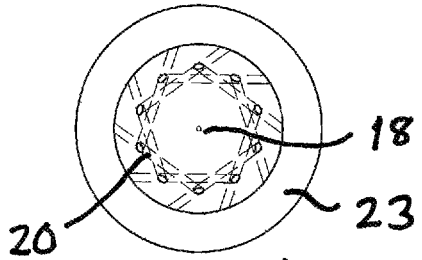
FIGS. 4*a* and 4*b* are schematic views illustrating how fuel channels are arranged in the valve needle of a fuel injector according to an embodiment of the invention.
Figure 4A:
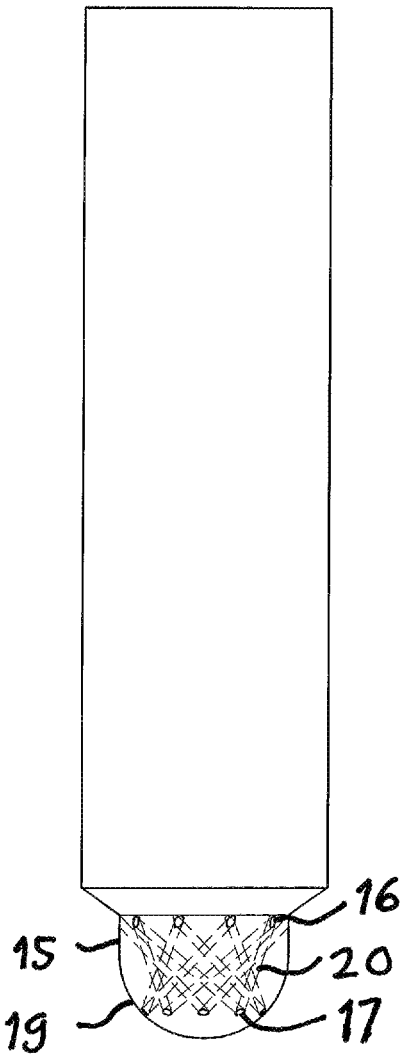

The design of the nozzle body and the valve needle constitutes the main features of the present invention and will now for one embodiment of the invention be described while making reference at the same time to FIGS. 2-4. The nozzle body 10 has an internal room 12 and a nozzle hole 13 connecting this room to the exterior of the nozzle body. A valve needle 9 is received in the internal room 12 and movable in a longitudinal direction thereof, i.e. in the direction of the arrow A, while extending into the nozzle wall hole 13 by an end part 14 thereof. The cross-section of the part of the valve needle 9 received in the internal room 12 is smaller than the cross-section of this room, so that an annular free space for receiving fuel pumped into this internal room is defined around this part of the valve needle.

The end part 14 of the valve needle has a first portion 15 with a circular cross-section and the same diameter as the nozzle hole 13. Inlets 16 of a plurality of fuel channels 20 are located at a circumferential surface of this first portion 15 of the valve needle while being uniformly distributed therearound. These fuel channels extend rectilinearly through the valve needle to outlets 17 uniformly distributed around a longitudinal center axis 18 of the valve needle as shown in FIG. 4*b*. These fuel channels extend in the valve needle so that they do not intersect each other and accordingly have no mutual communication. The outlets 17 are arranged in a third valve needle portion 19 defining a tip of the valve needle with a reduced cross-section with respect to the cross-section of the first valve needle portion 15, so that the outlets are arranged closer to said center axis 18 of the valve needle than the inlets. It is shown that each fuel channel 20 extends from the inlet 16 to the outlet 17 while making an angle of approximately 20° with said center axis 18 of the valve needle. The diameter of the fuel channels is approximately 0.1 mm.

The internal room 12 of the nozzle body has a bottom surface 21 surrounding the nozzle wall hole 13 defining a cross-section of this room perpendicularly to the longitudinal direction of the valve needle tapering towards the nozzle wall hole and the valve needle 9 has a second portion 22 connected to said first portion 15 with an enlarged cross-section with respect to the latter and tapering to the same degree as the bottom surface towards the first portion.

The function of the fuel injector according to this embodiment of the invention will now be described. When the valve needle 9 is in a first position shown in FIG. 2 with the tapering surface 23 of the second portion 22 of the valve 9 lifted out of contact with the bottom surface 21 of the internal room 12 of the nozzle body 10 the inlets 16 of the fuel channels 20 will be located inside the internal room 12 for receiving fuel from this internal room injected into a combustion chamber of a cylinder 2 of said engine by being sprayed out through the inlets 17 on the exterior of the nozzle body. By moving the valve needle 9 in the longitudinal direction thereof oppositely to the arrow A the inlets 16 of the fuel channels 20 will be applied on walls of the nozzle hole 13 preventing fuel from the internal room 12 of the nozzle body 10 to reach them, and the tapering surface 23 of the second portion 22 of the valve needle will at the same time come to sealingly bear against the bottom surface 21 of the internal room for efficiently sealing the internal room 12 with respect to the inlets 16 of the fuel channels and by that to the combustion chamber of the cylinder 2. This corresponds to the second position of the valve needle 9 with respect to the nozzle body 10 shown in FIG. 3.

The invention is of course in no way restricted to the embodiment described above, since many possibilities to modifications thereof are likely to be obvious to one skilled in the art without having to deviate from the scope of the invention defined in the appended claims.

The number of fuel channels in the valve needle may of course be different than shown in the figures, and the extension of these fuel channels through the valve needle may be different than for this embodiment with respect to the angles made with the longitudinal center axis of the valve needle.

The invention is not restricted to such fuel injectors for injection of any particular fuel, but diesel and ethanol may be mentioned by way of examples. The internal combustion engine may be a compression ignited engine or a spark ignited engine. Furthermore, the invention relates to fuel injectors used to inject fuel into cylinders in compression ignited combustion engines designed for any type of use, such as in industrial applications, in grinding machines and all types of motor vehicles, although the invention is particularly applicable to utility vehicles, especially wheeled utility vehicles, such as trucks or lorries and busses.

Neither is the invention restricted to any types of fuel injectors, such as a separate so-called unit injector for each cylinder of an engine with a plurality of cylinders or a fuel injector in common to all cylinders of the engine.

Such fuel injectors have normally a sack in the form of a small volume in an internal room inside the nozzle body. This sack is provided for being able to maintain a certain fuel pressure and for making the injector nozzle robust and able to withstand strains on different parts of the injector nozzle, such as caused by the movement of a valve needle inside the nozzle body. However, a disadvantage of the presence of such a sack is that it contributes to hydrocarbon emissions of the engine. This is because the sack is a dead volume where fuel may be gathered without being combusted, which is not desired, since this results in a reduced possibility to control the fuel to be combusted.

The disadvantages of such a sack is the reason for attempts to provide fuel injectors without a sack, but such fuel injectors are still rare, since the movement of the valve needle in the injector bodies of such fuel injectors have a tendency to destroy openings of holes in the nozzle body for spraying fuel into a cylinder of the engine.

The invention claimed is:

1. A fuel injector for an internal combustion engine comprising:

an injector nozzle with a nozzle body having an internal cavity and a nozzle wall hole connecting said internal cavity to an exterior of the nozzle body;

a valve needle movable in a longitudinal direction thereof and received in the internal cavity of the nozzle body while extending into said nozzle wall hole, wherein the valve needle comprises at least one internal fuel channel with an outlet configured to open to the exterior of the nozzle body in a first position of said valve needle with respect to the nozzle body allowing fuel to exit the outlet to thereby be injected into a combustion chamber of a cylinder of said engine; and means configured to move the valve needle in the longitudinal direction thereof between said first position and a second position, wherein in the second position, parts of the valve needle and of the nozzle body cooperate to prevent fuel from exiting said outlet, wherein said at least one fuel channel of said valve needle has a fuel inlet located at a circumferential surface of a first valve needle portion of said valve needle, where the first valve needle portion has a circular cross-section, wherein said nozzle wall hole of said nozzle body has a circular cross-section defined by walls extending in parallel with said longitudinal direction of the valve needle, where the circular cross-section of said nozzle wall hole of said valve body has a diameter that is the same as a diameter of said first valve needle portion, wherein the fuel inlet of said at least one fuel channel is configured to be in contact with said walls of said nozzle wall hole in said second position of the valve needle and in said first position of the valve needle, to be located inside said internal cavity of the nozzle body and out of contact with the walls of said nozzle wall hole due to the moving of said valve needle to said first position by said means to thereby allow the fuel inlet to receive fuel from the internal cavity, and wherein in said first position of said valve needle, the outlet of the at least one internal fuel channel is open to the exterior of the nozzle body thereby allowing fuel to flow from the internal cavity, via the fuel inlet of the at least one fuel internal channel, to the outlet of the at least one channel and thereby exit the fuel injector for injection into the combustion chamber of the cylinder of said engine.

2. A fuel injector according to claim 1, wherein the internal cavity of the nozzle body has a bottom surface surrounding said nozzle wall hole and the valve needle has a second valve needle portion connected to said first valve needle portion, wherein said second valve needle portion has an enlarged cross-section with respect to said first valve needle portion, and wherein said second valve needle portion has an outer surface configured to bear sealingly against the bottom surface of the internal cavity of the nozzle body in said second position of the valve needle inside the nozzle body.

3. A fuel injector according to claim 2, wherein said bottom surface of the internal cavity of the nozzle body defines a cross-section of said internal cavity perpendicularly to said longitudinal direction of the valve needle and tapering towards said nozzle wall hole, and that the cross-section of said second valve needle portion of the valve needle tapers correspondingly.

4. A fuel injector according to claim 1, wherein said at least one fuel channel has a rectilinear extension between said inlet and outlet.

5. A fuel injector according to claim 1, wherein said at least one fuel channel has said outlet opening configured to spray fuel out of said outlet in a direction at an angle greater than 0° with respect to said longitudinal direction of the valve needle.

6. A fuel injector according to claim 1, wherein the outlet of said at least one fuel channel is located in a third valve needle portion of the valve needle defining a tip of the valve needle with a reduced cross-section with respect to the cross-section of the first valve needle portion.

7. A fuel injector according to claim 1, wherein said at least one fuel channel has a diameter 0.2 mm.

8. A fuel injector according to claim 1, wherein said first valve needle portion of the valve needle has a diameter of 0.2-2 mm.

9. A fuel injector according to claim 1, wherein the valve needle has a plurality of separate said fuel channels with fuel inlets distributed around the periphery of said first valve needle portion and outlets separated from each other.

10. A fuel injector according to claim 9, wherein the inlets of the fuel channels are uniformly distributed around the periphery of the first valve needle portion.

11. A fuel injector according to claim 9, wherein the outlets of the fuel channels are uniformly distributed around a longitudinal center axis of the valve needle.

12. A fuel injector according to claim 1, wherein said at least one fuel channel has said outlet opening to spray fuel out there through in a direction making an angle between 10°-80°.

13. A fuel injector according to claim 1, wherein said at least one fuel channel has said outlet opening to spray fuel out there through in a direction making an angle between 10°-60°.

14. A fuel injector according to claim 1, wherein said at least one fuel channel has said outlet opening to spray fuel out there through in a direction making an angle between 15°-45°.

15. A fuel injector according to claim 1, wherein said at least one fuel channel has a diameter ≤0.1 mm.

16. A fuel injector according to claim 1, wherein said first valve needle portion has a diameter of 0.3-0.8 mm.

17. A fuel injector according to claim 1, wherein said first valve needle portion has a diameter of 0.5 mm.

18. An internal combustion engine comprising at least one fuel injector, wherein said fuel injector comprises:

an injector nozzle with a nozzle body having an internal cavity and a nozzle wall hole connecting said internal cavity to an exterior of the nozzle body;

a valve needle movable in a longitudinal direction thereof and received in the internal cavity of the nozzle body while extending into said nozzle wall hole, wherein the valve needle comprises at least one internal fuel channel with an outlet configured to open to the exterior of the nozzle body in a first position of said valve needle with respect to the nozzle body allowing fuel to exit the outlet to thereby be injected into a combustion chamber of a cylinder of said engine; and means configured to move the valve needle in the longitudinal direction thereof between said first position and a second position, wherein in the second position, parts of the valve needle and of the nozzle body cooperate to prevent fuel from exiting said outlet, wherein said at least one fuel channel of said valve needle has a fuel inlet located at a circumferential surface of a first valve needle portion of said valve needle, where the first valve needle portion has a circular cross-section, wherein said nozzle wall hole of said nozzle body has a circular cross-section defined by walls extending in parallel with said longitudinal direction of the valve needle, where the circular cross-section of said nozzle wall hole of said valve body has a diameter that is the same as a diameter of said first valve needle portion, wherein the fuel inlet of said at least one fuel channel is configured to be in contact with said walls of said nozzle wall hole in said second position of the valve needle and in said first position of the valve needle, to be located inside said internal cavity of the nozzle body and out of contact with the walls of said nozzle wall hole due to the moving of said valve needle to said first position by said means to thereby allow the fuel inlet to receive fuel from the internal cavity, and wherein in said first position of said valve needle, the outlet of the at least one internal fuel channel is open to the exterior of the nozzle body thereby allowing fuel to flow from the internal cavity, via the fuel inlet of the at least one fuel internal channel, to the outlet of the at least one channel and thereby exit the fuel injector for injection into the combustion chamber of the cylinder of said engine.

19. A motor vehicle comprising an internal combustion engine comprising at least one fuel injector, wherein said fuel injector comprises:

an injector nozzle with a nozzle body having an internal cavity and a nozzle wall hole connecting said internal cavity to an exterior of the nozzle body;

a valve needle movable in a longitudinal direction thereof and received in the internal cavity of the nozzle body while extending into said nozzle wall hole, wherein the valve needle comprises at least one internal fuel channel with an outlet configured to open to the exterior of the nozzle body in a first position of said valve needle with respect to the nozzle body allowing fuel to exit the outlet to thereby be injected into a combustion chamber of a cylinder of said engine; and means configured to move the valve needle in the longitudinal direction thereof between said first position and a second position, wherein in the second position, parts of the valve needle and of the nozzle body cooperate to prevent fuel from exiting said outlet, wherein said at least one fuel channel of said valve needle has a fuel inlet located at a circumferential surface of a first valve needle portion of said valve needle, where the first valve needle portion has a circular cross-section, wherein said nozzle wall hole of said nozzle body has a circular cross-section defined by walls extending in parallel with said longitudinal direction of the valve needle, where the circular cross-section of said nozzle wall hole of said valve body has a diameter that is the same as a diameter of said first valve needle portion, wherein the fuel inlet of said at least one fuel channel is configured to be in contact with said walls of said nozzle wall hole in said second position of the valve needle and in said first position of the valve needle, to be located inside said internal cavity of the nozzle body and out of contact with the walls of said nozzle wall hole due to the moving of said valve needle to said first position by said means to thereby allow the fuel inlet to receive fuel from the internal cavity, and wherein in said first position of said valve needle, the outlet of the at least one internal fuel channel is open to the exterior of the nozzle body thereby allowing fuel to flow from the internal cavity, via the fuel inlet of the at least one fuel internal channel, to the outlet of the at least one channel and thereby exit the fuel injector for injection into the combustion chamber of the cylinder of said engine.

* * * * *